US009897363B2

(12) United States Patent
Zimmermann

(10) Patent No.: US 9,897,363 B2
(45) Date of Patent: Feb. 20, 2018

(54) TRANSCRITICAL CARBON DIOXIDE REFRIGERATION SYSTEM WITH MULTIPLE EJECTORS

(71) Applicant: HEATCRAFT REFRIGERATION PRODUCTS LLC, Richardson, TX (US)

(72) Inventor: Augusto J. Pereira Zimmermann, Stone Mountain, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 320 days.

(21) Appl. No.: 14/542,704

(22) Filed: Nov. 17, 2014

(65) Prior Publication Data

US 2016/0138847 A1 May 19, 2016

(51) Int. Cl.

| | |
|---|---|
| ***F25B 7/00*** | (2006.01) |
| ***F25D 3/12*** | (2006.01) |
| ***F25B 1/10*** | (2006.01) |
| ***F25B 5/00*** | (2006.01) |
| ***F25B 9/00*** | (2006.01) |
| ***F25B 41/00*** | (2006.01) |

(52) U.S. Cl.

CPC ..... *F25D 3/12* (2013.01); *F25B 1/10* (2013.01); *F25B 5/00* (2013.01); *F25B 9/008* (2013.01); *F25B 41/00* (2013.01); *F25B 2309/061* (2013.01); *F25B 2341/0012* (2013.01); *F25B 2341/0015* (2013.01); *F25B 2400/054* (2013.01); *F25B 2400/072* (2013.01); *F25B 2400/075* (2013.01)

(58) Field of Classification Search

CPC ..... F25B 1/10; F25B 1/06; F25B 5/00; F25B 2341/0015; F25B 9/008; F25B 5/04; F25B 5/02; F25B 2400/075

See application file for complete search history.

(56) References Cited

U.S. PATENT DOCUMENTS

| | | | | |
|---|---|---|---|---|
| 7,178,359 | B2 | 2/2007 | Oshitani et al. | |
| 7,779,647 | B2 | 8/2010 | Takeuchi et al. | |
| 2004/0123624 | A1 | 7/2004 | Ohta et al. | |
| 2012/0291461 | A1 | 11/2012 | Verma et al. | |
| 2013/0111944 | A1* | 5/2013 | Wang | F25B 41/00 62/500 |
| 2013/0125569 | A1* | 5/2013 | Verma | F25B 1/10 62/115 |
| 2014/0345318 | A1* | 11/2014 | Nagano | F25B 41/00 62/500 |
| 2015/0184898 | A1* | 7/2015 | Vaisman | F25B 5/02 62/115 |
| 2016/0102901 | A1* | 4/2016 | Christensen | F25B 1/10 62/117 |

FOREIGN PATENT DOCUMENTS

| | | |
|---|---|---|
| JP | 2001-221517 A | 8/2001 |
| WO | 2012/168544 A1 | 12/2012 |

* cited by examiner

*Primary Examiner* — Elizabeth Martin

(74) *Attorney, Agent, or Firm* — Baker Botts L.L.P.

(57) ABSTRACT

The present application provides a carbon dioxide based refrigeration system. The carbon dioxide based refrigeration system may include a mid temperature cycle with a mid temperature ejector, a low temperature cycle with a low temperature ejector, and a gas cooler/condenser in communication with the mid temperature cycle and the low temperature cycle.

16 Claims, 4 Drawing Sheets

TRANSCRITICAL CARBON DIOXIDE REFRIGERATION SYSTEM WITH MULTIPLE EJECTORS

TECHNICAL FIELD

The present application and the resultant patent relate generally to refrigeration systems and more particularly relate to a transcritical carbon dioxide refrigeration system using multiple ejectors at multiple temperatures for improved overall efficiency.

BACKGROUND OF THE INVENTION

Current refrigeration trends promote the use of carbon dioxide and other types of natural refrigerants as opposed to conventional hydrofluorocarbon based refrigerants. Although such carbon dioxide based refrigeration systems may be considered more environmentally friendly, such systems tend to be less efficient and, hence, may require more overall power usage given the low critical point and therefore high throttling losses between the heat rejection and heat absorption process in a conventional refrigeration cycle.

There is thus a desire for refrigeration systems using natural refrigerants such as carbon dioxide with improved efficiency and improved overall energy consumption. Preferably such an improved refrigeration system may be environmentally friendly with reduced overall operational and maintenance requirements.

SUMMARY OF THE INVENTION

The present application and the resultant patent thus provide a carbon dioxide based refrigeration system. The carbon dioxide based refrigeration system may include a mid temperature cycle with a mid temperature ejector, a low temperature cycle with a low temperature ejector, and a gas cooler/condenser in communication with the mid temperature cycle and the low temperature cycle.

The present application and the resultant patent further provide a method of operating a carbon dioxide based refrigeration system. The method may include the steps of flowing a first portion of a carbon dioxide refrigerant to a mid temperature ejector, accelerating the first portion of the flow of the carbon dioxide refrigerant in the mid temperature ejector, flowing the first portion of the flow of the carbon dioxide refrigerant to a mid temperature suction group, flowing a second portion of the carbon dioxide refrigerant to a low temperature ejector, accelerating the second portion of the flow of the carbon dioxide refrigerant in the low temperature ejector, and flowing the second portion of the flow of the carbon dioxide refrigerant to a low temperature suction group.

The present application and the resultant patent further provide a refrigeration system. The refrigeration system may include a flow of a carbon dioxide refrigerant, a mid temperature cycle with a mid temperature ejector, a low temperature cycle with a low temperature ejector and a gas cooler/condenser in communication with the mid temperature cycle, and the low temperature cycle. A first portion of the flow of the carbon dioxide refrigerant flows through the mid temperature cycle and a second portion of the flow of the carbon dioxide refrigerant flows through the low temperature cycle.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
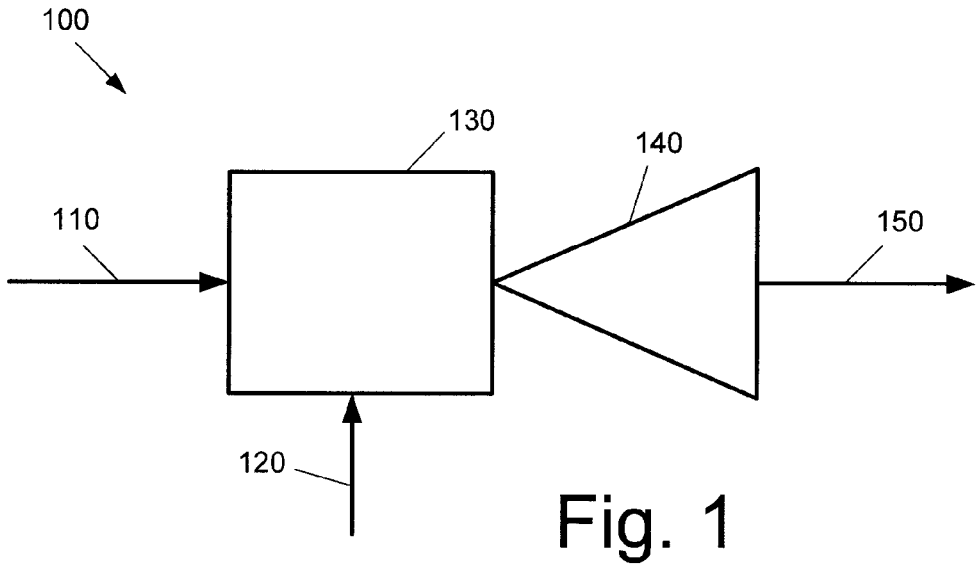
FIG. 1 is a schematic diagram of an ejector described herein.

Referring now to the drawings, in which like numerals refer to like elements throughout the several views, FIG. 1 shows an example of an ejector 100 as may be described herein. Generally described, the ejector 100 may be a mechanical device with or without any moving parts. Instead, the ejector 100 mixes two fluid streams based upon a momentum transfer between a motive fluid and a suction fluid. A motive inlet 110 may be in communication with a first flow under pressure. The ejector 100 also may include a suction inlet 120 in communication with a second flow. The ejector 100 also may include a mixing tube 130 and a diffuser 140. The motive flow may be reduced in pressure as the suction flow is accelerated therein. The flows are mixed in the mixing tube 130 and flow through the diffuser 140 as a mixed flow. The mixed flow may be discharged at an outlet 150 at a pressure greater than the suction flow but less than the motive flow. The overall suction capability for the ejector 100 may be based upon the net positive suction head available therein. Other component and other configurations also may be used herein.

Figure 2:
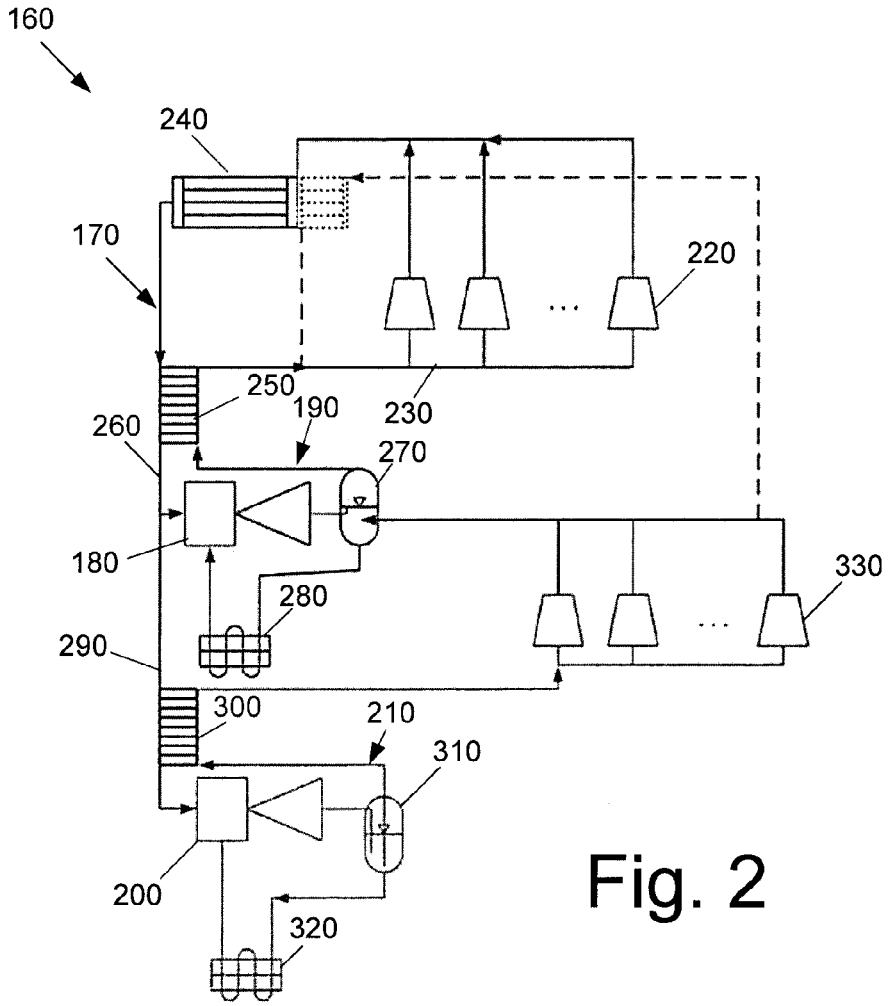
FIG. 2 is a schematic diagram of a transcritical carbon dioxide refrigeration system as may be described herein.

FIG. 2 shows an example of a carbon dioxide based refrigeration system 160 as may be described herein. The transcritical carbon dioxide based refrigeration system 160 may include a number of the ejectors 100 in a parallel configuration 170. In this example, a medium temperature ejector 180 may be used in a medium temperature cycle 190 and a low temperature ejector 200 may be used in a low temperature cycle 210. Other components and other configurations also may be used herein. As the names imply, the mid temperature cycle 190 and the low temperature cycle 210 operate at different temperatures.

The mid temperature cycle 190 may include any number of mid temperature suction groups 220 or compressors. The mid temperature suction groups 220 may be used herein in a parallel configuration or otherwise. The mid temperature suction groups 220 compress a flow of a carbon dioxide refrigerant 230. Other types of refrigerant flows may be used herein. The carbon dioxide refrigerant 230 may be forwarded to a gas cooler/condenser 240. The carbon dioxide refrigerant 230 may lose or reject heat in the gas cooler/condenser. The mid temperature cycle 190 also may include a mid temperature suction line heat exchanger 250. The mid temperature suction line heat exchanger 250 may exchange heat between the flow of refrigerant 230 entering the mid temperature suction groups 220 and the flow of refrigerant 230 leaving the gas cooler/condenser 240. Other components and other configurations also may be used herein.

A first portion 260 of the flow of refrigerant 230 leaving the gas cooler/condenser 240 may be directed to the mid temperature ejector 180. The first portion 260 of the refrigerant flow 230 may be substantially gaseous. The mid temperature ejector 180 also may be in communication with a mid temperature flash tank 270 and one or more mid temperature evaporators 280. The mid temperature evaporators 280 may be evenly or unevenly sized to cover a certain capacity range and modulation. The first portion 260 of the flow 230 may enter the mid temperature ejector 180 at the motive inlet 110 as the motive flow. The flow of refrigerant 230 from the mid temperature evaporators 280 may enter the suction inlet 120 in a liquid state as the suction flow. The motive flow of refrigerant 230 thus may be accelerated and reduced in pressure upon leaving the outlet 150. The flow of refrigerant 230 then may again be separated into vapor and liquid form in the temperature flash tank 270. The vaporized refrigerant 230 may be returned to the mid temperature suction groups 220 via the mid temperature suction line heat exchanger 250 while the liquid flow may be sent to the mid temperature evaporators 280 and back to the mid temperature ejector 180. Other components and other configurations also may be used herein.

A second portion 290 of the flow of refrigerant 230 from the gas cooler/condenser 240 may be routed to the low temperature ejector 220 of the low temperature cycle 210. The second portion 290 of the flow of refrigerant 230 may first pass through a low temperature suction line heat exchanger 300. The low temperature ejector 200 also may be in communication with a low temperature flash tank 310 and one or more low temperature evaporators 320. The low temperature evaporators 320 may be evenly or unevenly sized to cover a certain capacity range and modulation. The second portion 290 of the flow of refrigerant 230 thus may enter the motive inlet 110 of the low temperature ejector 200 while the flow of refrigerant 230 from the low temperature evaporator 320 may enter at the suction inlet 120. Again the mixed flow may be accelerated and reduced in pressure. The mixed flow thus leaves the outlet 150 of the low temperature ejector 200 and flows to the low temperature flash tank 310. The vaporized portion of the flow of refrigerant 230 may flow through the low temperature suction line heat exchanger 300 and towards a number of low temperature suction groups 330 or compressors. The flow of refrigerant 230 then may be forwarded to the mid temperature flash tank 270 or directly back to the gas cooler/condenser 240. The liquid portion of the flow of refrigerant 230 may pass through the low temperature evaporator 320 and back to the low temperature ejector 200. The cycle then may be repeated.

The use of the ejectors 180, 200 serves to recover pressure/work herein. The work recovered from the expansion process may be used to compress the vaporized refrigerant before entering into the compressors/suction groups. Accordingly, the pressure ratio of the suction groups (and thus the overall power consumption) may be reduced for a given evaporator pressure. The quality of the refrigerant also may be reduced. The overall number of pumps also may be reduced and/or eliminated.

Figure 3:
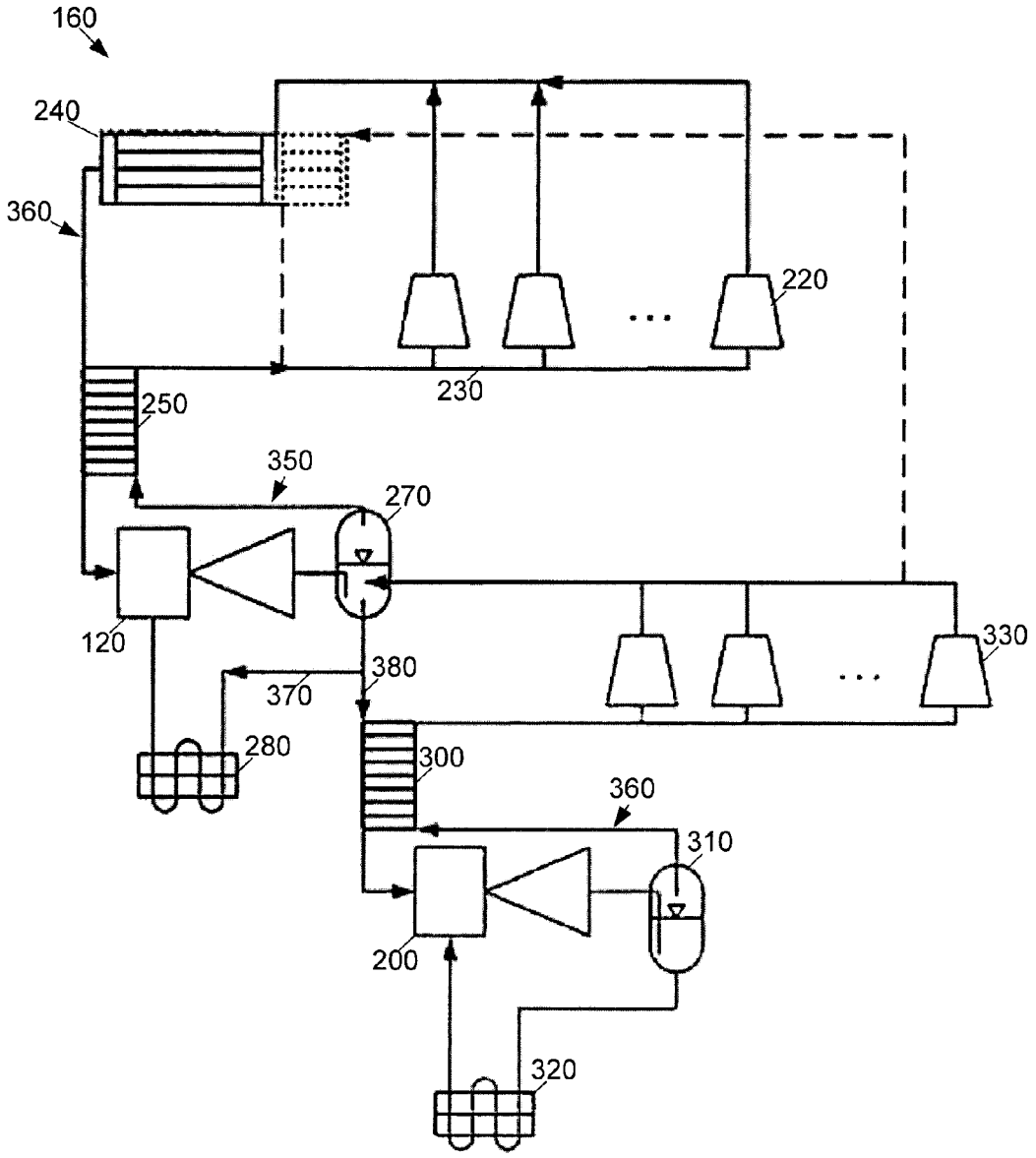
FIG. 3 is an alternative embodiment of a transcritical carbon dioxide refrigeration system as may be described herein.

FIG. 3 shows an alternative embodiment of a carbon dioxide refrigeration system 160. In this example, the ejectors 100 may be positioned in a series configuration 340. Specifically, a medium temperature cycle 350 and a low temperature cycle 360 may be positioned in a series configuration 340. Other components and other configurations may be used herein.

The mid temperature cycle 350 may include the mid temperature suction groups 220, the gas cooler/condenser 240, and the mid temperature suction line heat exchanger 250 substantially as described above. In this example, however, the entire flow of refrigerant 230 may be directed to the mid temperature ejector 180. The mid temperature ejector 180 also may be in communication with the mid temperature flash tank 270 and the mid temperature evaporator 280. In this example, a first portion 370 of the fluid refrigerant 230 may be directed to the mid temperature evaporators 280 while a second portion 380 may be forwarded to the low temperature cycle 360.

The lower temperature cycle 360 also may include the low temperature suction line heat exchanger 300 and the low temperature ejector 200 in communication with the low temperature flash tank 310 and the low temperature evaporator 320. The low temperature cycle 360 also includes the low temperature suction groups 330. The flow of refrigerant 230 thus flows first through the mid temperature cycle 350 and then through the low temperature cycle 360 before being returned to either the mid temperature flash tank 270 and/or the gas cooler/condenser 240. Other components and other configurations may be used herein.

Figure 4:
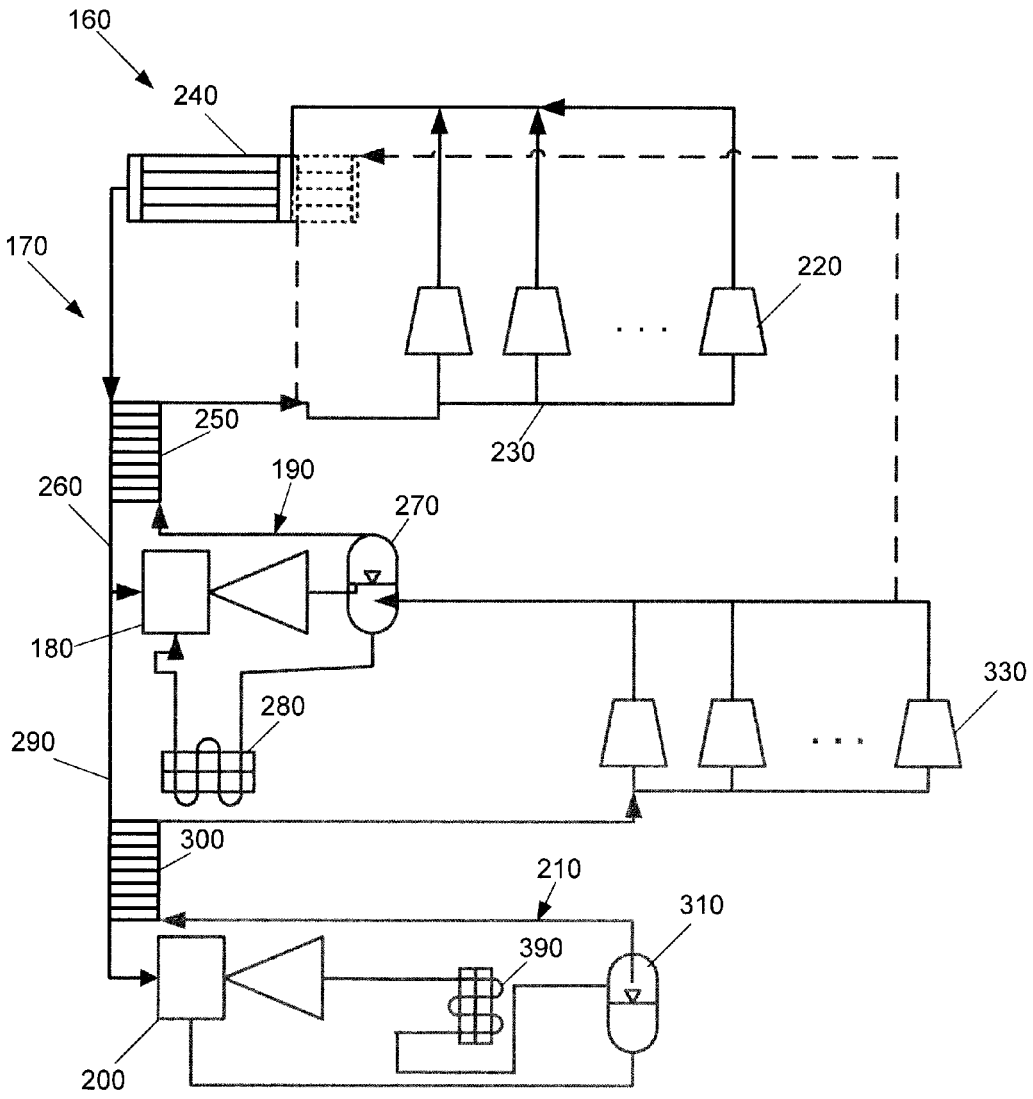
FIG. 4 is an alternative embodiment of a transcritical carbon dioxide refrigeration system as may be described herein.

FIG. 4 shows an alternative embodiment of FIG. 2. In this example, an evaporator 390 or an assembly of evaporators 390 in a parallel configuration are positioned between the outlet of the low temperature ejector 200 and the inlet of the low temperature flash tank 310. Further, the flash tank liquid outlet is fed into the ejector suction port 120 in the low temperature cycle 210. This alternative embodiment enables overfeeding of the evaporator coils with liquid such that they can have heat transfer performance enhancement.

Figure 5:
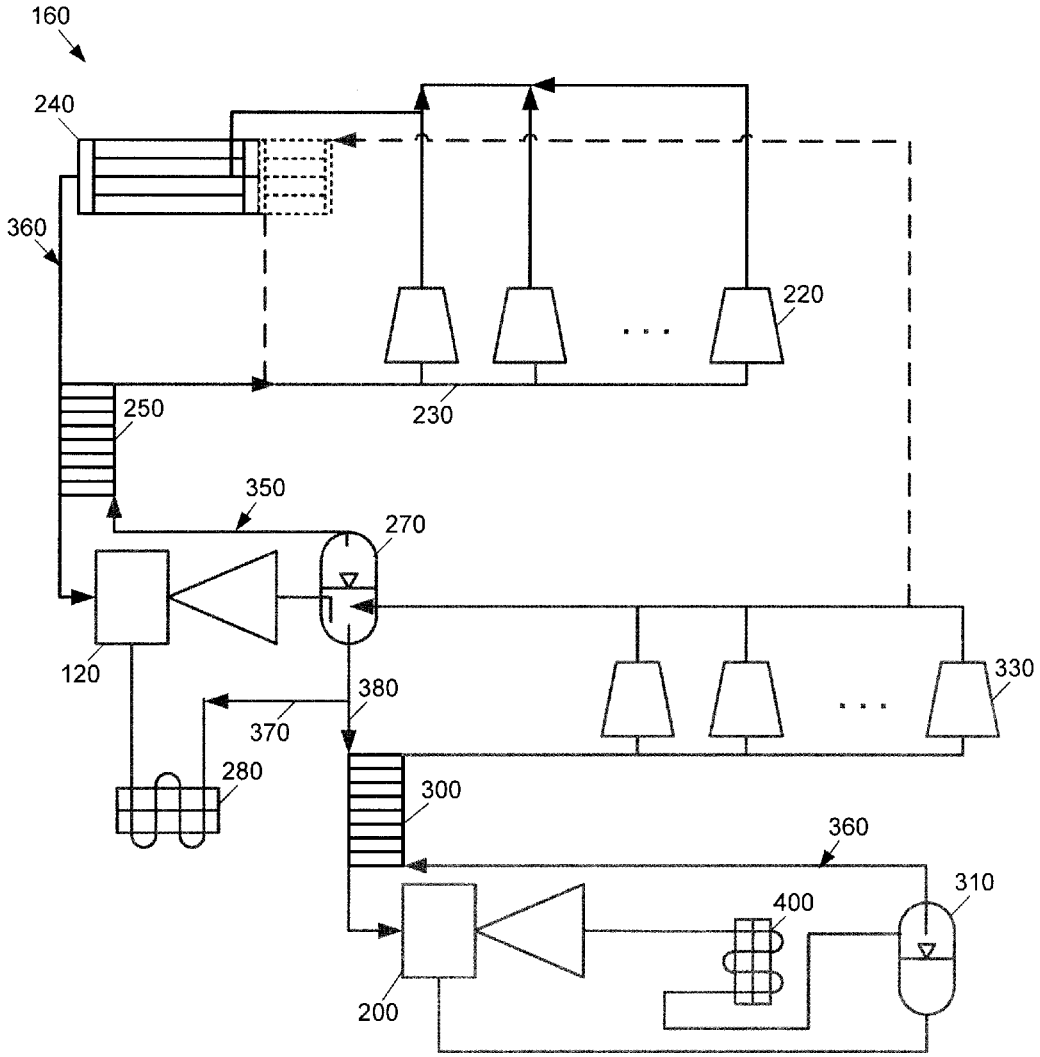
FIG. 5 is an alternative embodiment of a transcritical carbon dioxide refrigeration system as may be described herein.

FIG. 5 shows an alternative embodiment of the transcritical carbon dioxide based refrigeration system 160 of FIG. 3. In this example, an evaporator 400 or an assembly of evaporators 400 in a parallel configuration are positioned in between the outlet of the low temperature ejector 200 and the inlet of the low temperature flash tank 310. Further, the flash tank liquid outlet is fed into the ejector suction port 120 in the low temperature cycle 210. This alternative embodiment also enables overfeeding of the evaporator coils with liquid such that they can have heat transfer performance enhancement.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A system, comprising:

a gas cooler/condenser;

a first temperature cycle comprising:

a first ejector configured to receive refrigerant through a motive inlet of the first ejector from the gas cooler/condenser;

a first flash tank configured to receive refrigerant from an outlet of the first ejector;

a first evaporator configured to receive refrigerant from the first flash tank, wherein refrigerant flows from the first evaporator to the first ejector through a suction inlet of the first ejector; and first suction groups downstream the first flash tank; and a second temperature cycle comprising:

a second ejector configured to receive refrigerant;

a second flash tank downstream from the second ejector;

a second evaporator downstream from the second ejector; and second suction groups downstream from the second flash tank;

wherein the gas cooler/condenser is configured to receive refrigerant from the first suction groups.

2. The system of claim 1, wherein the first temperature cycle and second temperature cycle comprise a parallel configuration such that the motive inlet of the first ejector and a motive inlet of the second ejector are in parallel in relation to an outlet of the gas cooler/condenser.

3. The system of claim 1, wherein the first temperature cycle and second temperature cycle comprise a series configuration such that a motive inlet of the second ejector is downstream from the outlet of the first ejector.

4. The system of claim 1, wherein the system is a transcritical carbon dioxide refrigeration system.

5. The system of claim 1, wherein the first temperature cycle further comprises a first suction line heat exchanger between the first flash tank and the first suction groups and between the gas cooler/condenser and the motive inlet of the first ejector.

6. The system of claim 1, wherein the second temperature cycle further comprises a second suction line heat exchanger between the second flash tank and the second suction groups and between the gas cooler/condenser and the motive inlet of the second ejector.

7. The system of claim 1, wherein the second evaporator is configured to receive refrigerant from the second flash tank and the second ejector is configured to receive refrigerant at a suction inlet from the second evaporator.

8. The system of claim 1, wherein the second flash tank is configured to receive refrigerant from the second evaporator and the second ejector is configured to receive refrigerant at a suction inlet from the second flash tank.

9. The system of claim 1, further comprising a carbon dioxide based refrigerant, wherein at least a portion of the carbon dioxide based refrigerant flows directly from the second suction groups to the gas cooler/condenser.

10. The system of claim 1, further comprising a carbon dioxide based refrigerant, wherein a portion of the carbon dioxide based refrigerant flows through the first temperature cycle and an other portion of the carbon dioxide based refrigerant flows through the second temperature cycle.

11. The system of claim 1, further comprising a carbon dioxide based refrigerant, wherein a portion of the carbon dioxide based refrigerant flows from the second temperature cycle to the first temperature cycle from the second suction groups to the first flash tank.

12. The system of claim 1, wherein the first temperature cycle operates at a higher temperature than the second temperature cycle.

13. A method, comprising:

flowing a portion of a carbon dioxide refrigerant from a gas cooler/condenser to a first ejector;

accelerating the portion of the flow of the carbon dioxide refrigerant in the first ejector;

separating the portion of the flow of the carbon dioxide refrigerant into a vapor part and a liquid part at a first flash tank;

flowing the vapor part of the portion of the flow of the carbon dioxide refrigerant to a first suction group downstream from the first flash tank;

flowing an other portion of the carbon dioxide refrigerant from the gas cooler/condenser to a second ejector;

accelerating the other portion of the flow of the carbon dioxide refrigerant in the second ejector; and separating the other portion of the flow of the carbon dioxide refrigerant into a vapor part and a liquid part at a second flash tank;

flowing the vapor portion of the other portion of the flow of the carbon dioxide refrigerant to a second suction group downstream from the second flash tank.

14. The method of claim 13, further comprising:

evaporating the portion of the flow of carbon dioxide refrigerant at a first evaporator downstream from the first ejector; and evaporating the other portion of the flow of carbon dioxide refrigerant at a second evaporator downstream from the second ejector.

15. The method of claim 14, wherein evaporating the other portion of the flow of carbon dioxide refrigerant at the second evaporator comprises flowing the other portion of the flow of carbon dioxide refrigerant from the second evaporator to the second flash tank and then to a suction inlet of the second ejector.

16. The method of claim 14, wherein evaporating the other portion of the flow of carbon dioxide refrigerant at the second evaporator comprises flowing the other portion of the flow of carbon dioxide refrigerant from an outlet of the second ejector to the second flash tank and then from the flash tank to the second evaporator.

* * * * *